US006428129B1

(12) United States Patent
Chen

(10) Patent No.: US 6,428,129 B1
(45) Date of Patent: Aug. 6, 2002

(54) CABINET

(76) Inventor: Shun-Teng Chen, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/922,907

(22) Filed: Aug. 3, 2001

(51) Int. Cl.[7] ..... A47B 88/00
(52) U.S. Cl. ..... 312/348.1; 312/330.1
(58) Field of Search ..... 312/330.1, 348.1, 312/348.2, 348.4, 334.1, 334.6, 257.1, 263, 294

(56) References Cited

U.S. PATENT DOCUMENTS 1,352,002 A * 9/1920 Jones ..... 312/348.2
2,701,174 A * 2/1955 Franks ..... 312/348.1 X
3,650,592 A * 3/1972 Williams ..... 312/348.1
5,823,650 A * 10/1998 Lin ..... 312/348.2 X
5,921,648 A * 7/1999 Rong ..... 312/348.4
5,927,841 A * 7/1999 Ferrari et al. ..... 312/348.1
6,056,841 A * 5/2000 Nien ..... 312/348.1

FOREIGN PATENT DOCUMENTS

IT 525161 * 4/1955 ..... 312/348.4

* cited by examiner

*Primary Examiner*—James O. Hansen

(57) ABSTRACT

A cabinet has a main frame having at least a pair of rails, and at least a drawer disposed in the main frame. The drawer has a front plate, a base plate, a U-shaped frame, a pair of positioning bars, and a pair of connection plates. Each positioning bar has an upper block and a bottom groove for receiving a top portion of the U-shaped frame. The front plate has a handle button, two click grooves, and a plurality of sockets to engage-with the base plate. The base plate has two front protrusions, and a U-shaped channel for receiving the U-shaped frame. The front protrusions of the base plate engage with a bottom of the front plate. Each click groove of the front plate receives the upper block of the corresponding positioning bar.

5 Claims, 5 Drawing Sheets

CABINET

BACKGROUND OF THE INVENTION

The present invention relates to a cabinet. More particularly, the present invention relates to a cabinet which is easily assembled and detached.

A conventional cabinet is very heavy. Since the whole cabinet cannot be detached, the user cannot move the conventional cabinet alone.

SUMMARY OF THE INVENTION

An object of the present invention is to provide a cabinet which is easily assembled.

Another object of the present invention is to provide a cabinet which is easily detached.

Another object of the present invention is to provide a cabinet which has a drawer and two support mounts to support the drawer when the drawer is opened.

Accordingly, a cabinet comprises a main frame having at least a pair of rails, and at least a drawer disposed in the main frame. The drawer has a front plate, a base plate, a U-shaped frame, and a pair of positioning bars. Each of the positioning bars has an upper block and a bottom groove for receiving a top portion of the U-shaped frame. The front plate has a handle button, two click grooves, and a plurality of sockets to engage with the base plate. The base plate has two front protrusions, and a U-shaped channel for receiving the U-shaped frame. The front protrusions of the base plate engage with a bottom of the front plate. Each of the click grooves of the front plate receives the upper block of the corresponding positioning bar.

DETAILED DESCRIPTION OF THE INVENTION

Figure 1:
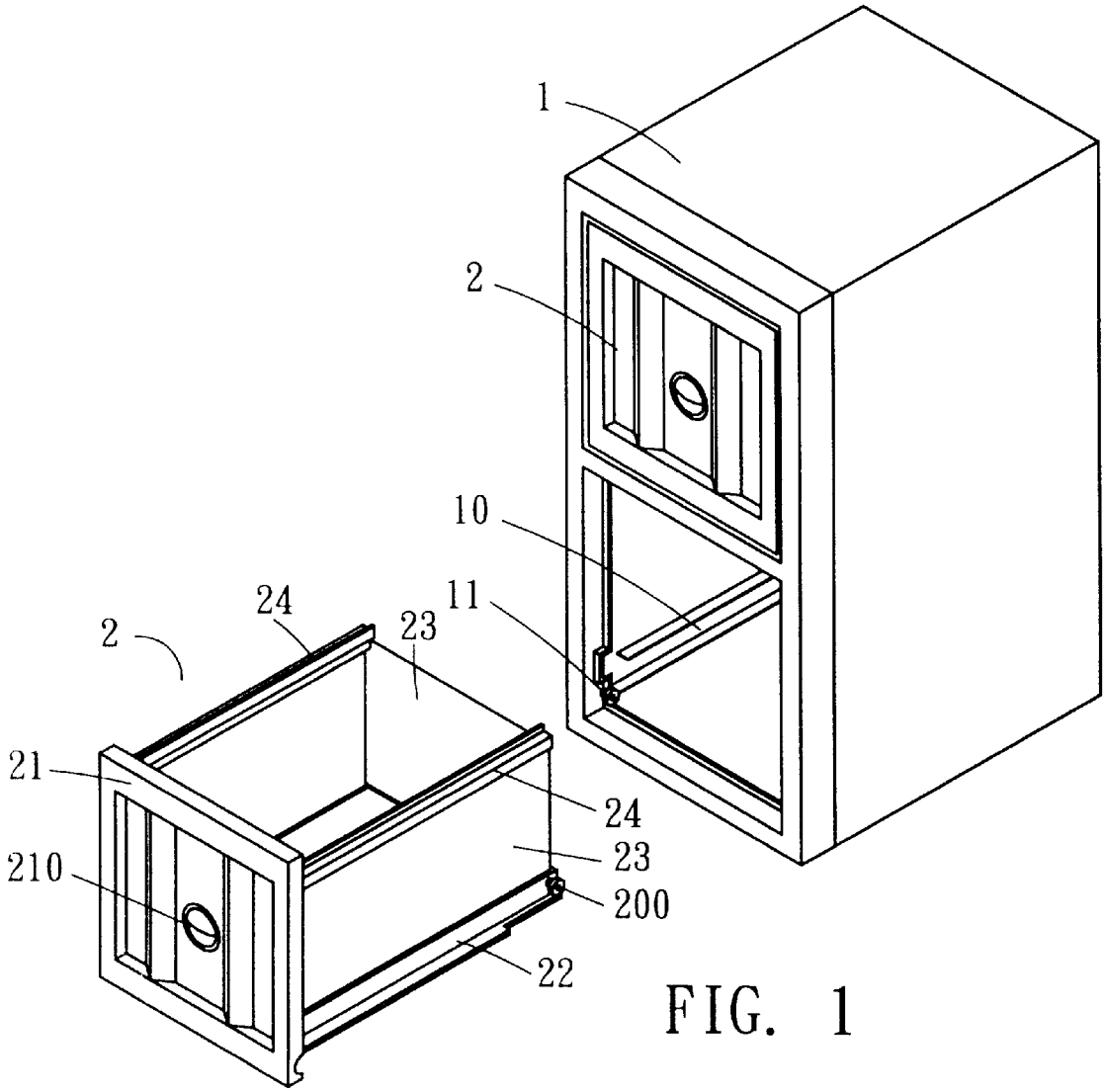
FIG. 1 is a perspective view of a cabinet of a preferred embodiment in accordance with the present invention.
Figure 2:
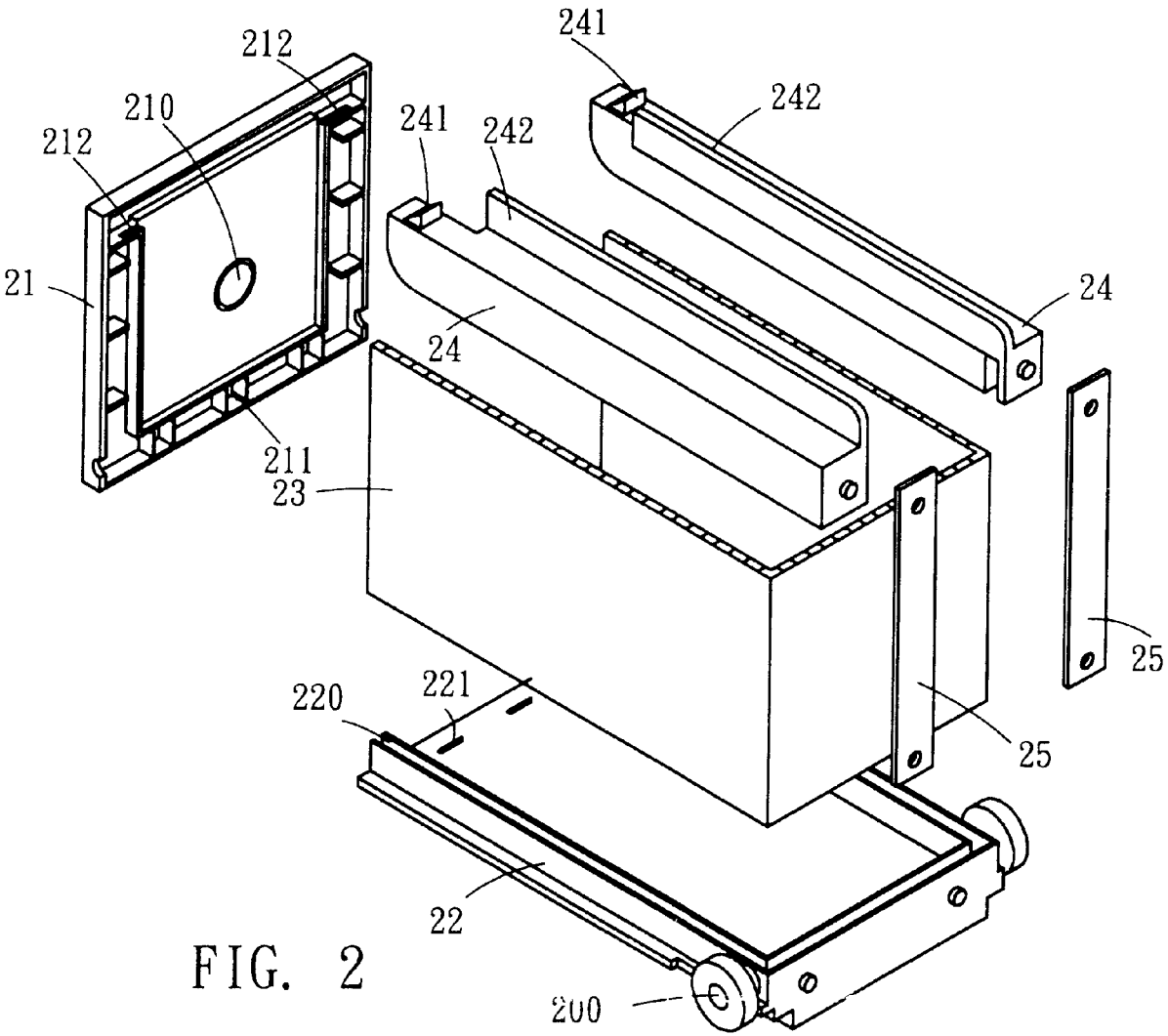
FIG. 2 is a perspective exploded view of a drawer of a preferred embodiment in accordance with the present invention.
Figure 3:
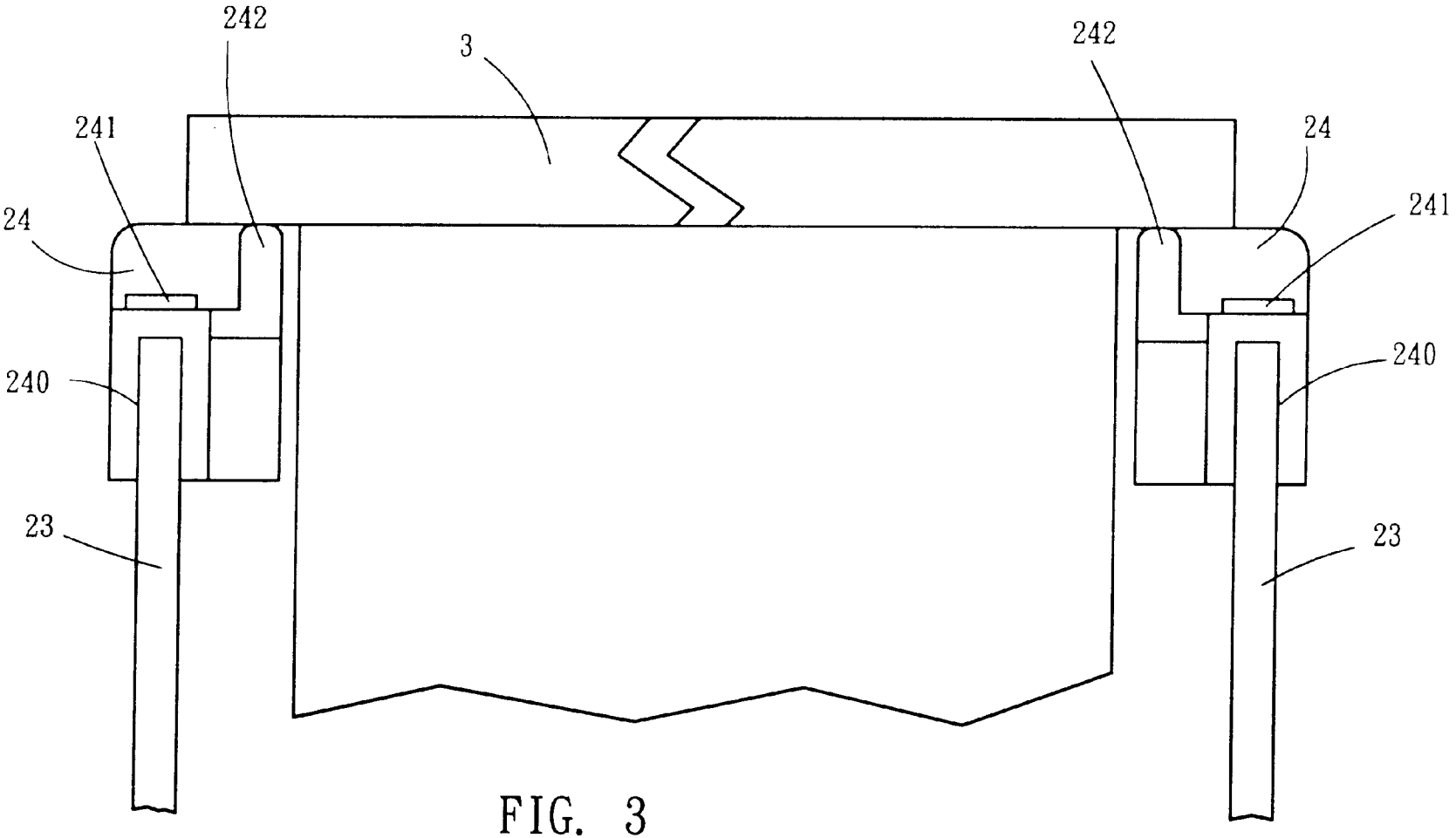
FIG. 3 is a schematic view illustrating a file is placed in a drawer of a preferred embodiment in accordance with the present invention.

Referring to FIGS. 1 to 3, a cabinet comprises a main frame 1 having at least a pair of rails 10 and at least an inner pulley 11, and at least a drawer 2 disposed in the main frame 1.

The drawer 2 has a front plate 21, a base plate 22, a U-shaped frame 23, a pair of positioning bars 24, and a pair of connection plates 25.

Each of the positioning bars 24 has an upper block 241 and a bottom groove 240 for receiving a top portion of the U-shaped frame 23.

The front plate 21 has a handle button 210, two click grooves 212, and a plurality of sockets 211 to engage with the base plate 22.

The base plate 22 has two front protrusions 221, and a U-shaped channel 220 for receiving the U-shaped frame 23.

The front protrusions 221 of the base plate 22 engage with a bottom of the front plate 21.

Each of the click grooves 212 of the front plate 21 receives the upper block 241 of the corresponding positioning bar 24.

Each of the connection plates 25 is connected to the base plate 22 and the corresponding positioning bar 24.

Two rear rollers 200 are disposed on the base plate 22 to engage with the rails 10.

Each of the positioning bars 24 further has an upper flange 242 to support a file 3.

Figure 4:
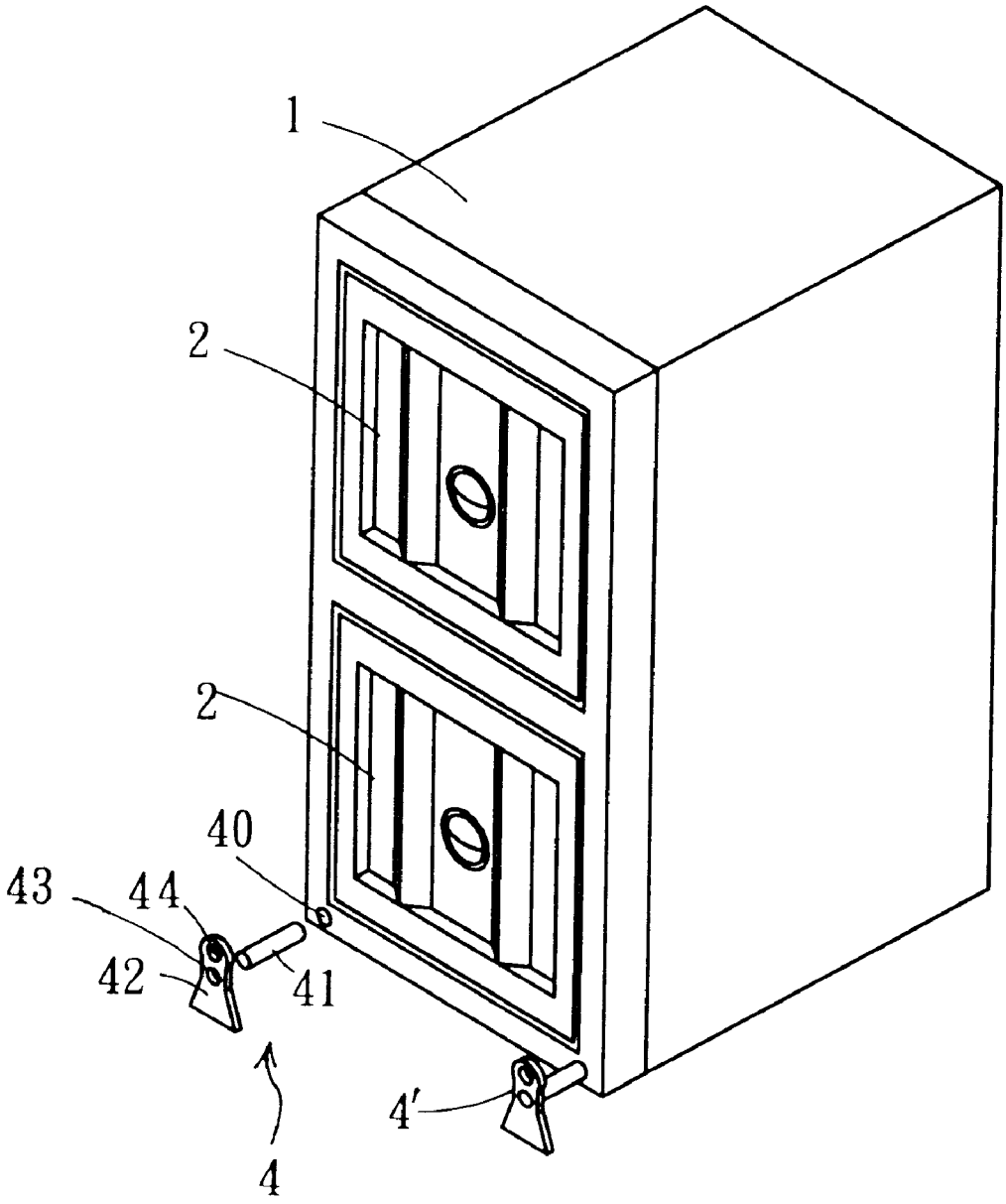
FIG. 4 is a perspective schematic view illustrating two support mounts are disposed on a drawer.
Figure 5:
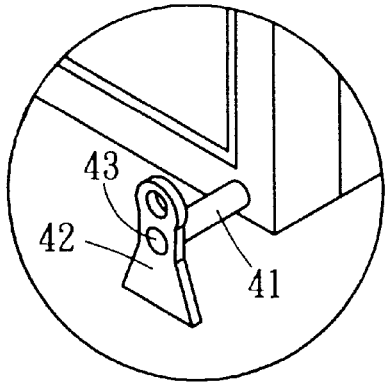
FIG. 5 is a partially enlarged view of FIG. 4.
Figure 6:
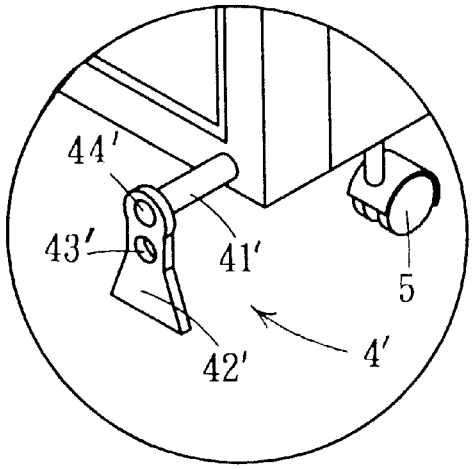
FIG. 6 is a perspective schematic view illustrating a caster is disposed on a bottom of a cabinet.

Referring to FIGS. 4 to 6, a first support mount 4 and a second support mount 4' are disposed on the drawer 21.

The front plate 21 further has a pair of round holes 40.

The first support mount 4 has a first panel 42 having a first circular hole 43 and a second circular hole 44, and a first tube 41 inserted through the first circular hole 43 of the first panel 42 and the corresponding round hole 40 of the front plate 21.

The second support mount 4' has a second panel 42' having a third circular hole 43' and a fourth circular hole 44', and a second tube 41' inserted through the fourth circular hole 44' of the second panel 42' and the corresponding round hole 40 of the front plate 21.

When the drawer 2 is opened, the first support mount 4 and the second support mount 4' will support the drawer 2.

The invention is not limited to the above embodiment but various modification thereof may be made. Further, various changes in form and detail may be made without departing from the scope of the invention.

I claim:

1. A cabinet comprises:

a main frame having at least a pair of rails, and at least a drawer disposed in the main frame, the drawer having a front plate, a base plate, a U-shaped frame, and a pair of positioning bars, each of the positioning bars having an upper block and a bottom groove for receiving a top portion of the U-shaped frame, the front plate having a handle button, two click grooves, and a plurality of sockets to engage with the base plate, the base plate having two front protrusions, and a U-shaped channel for receiving the U-shaped frame, the front protrusions of the base plate engaging with a bottom of the front plate, and each of the click grooves of the front plate receiving the upper block of the corresponding positioning bar.

2. The cabinet as claimed in claim 1, wherein two connection plates are connected to the base plate and the positioning bars.

3. The cabinet as claimed in claim 1, wherein two rear rollers are disposed on the base plate to engage with the rails.

4. The cabinet as claimed in-claim 1, wherein each of the positioning bars further has an upper flange.

5. The cabinet as claimed in claim 1, wherein the front plate further has a pair of round holes, and a pair of support mounts are inserted through the round holes of the front plate.

* * * * *